US007845095B2

(12) United States Patent
Langvin et al.

(10) Patent No.: US 7,845,095 B2
(45) Date of Patent: Dec. 7, 2010

(54) ARTICLE OF FOOTWEAR FOR USE WITH A LEFT FOOT AND A RIGHT FOOT

(75) Inventors: Elizabeth Langvin, Tigard, OR (US); Michael A. Aveni, Lake Oswego, OR (US); Marni L. Gerber, West Linn, OR (US)

(73) Assignee: Nike, Inc., Beaverton, OR (US)

( * ) Notice: Subject to any disclaimer, the term of this patent is extended or adjusted under 35 U.S.C. 154(b) by 782 days.

(21) Appl. No.: 11/682,812

(22) Filed: Mar. 6, 2007

(65) Prior Publication Data

US 2008/0216353 A1 Sep. 11, 2008

(51) Int. Cl.
*A43B 13/38* (2006.01)

(52) U.S. Cl. ..... 36/44; 36/154

(58) Field of Classification Search ..... 36/44, 36/154, 43, 93, 88, 25 R, 11.5
See application file for complete search history.

(56) References Cited

U.S. PATENT DOCUMENTS

| | | | | |
|---|---|---|---|---|
| 1,291,958 | A | 1/1919 | Lund | |
| D151,685 | S | 11/1948 | Eberle et al. | |
| D160,729 | S | 10/1950 | Murphy | |
| 2,598,217 | A * | 5/1952 | Bronson | 36/110 |
| D186,210 | S | 9/1959 | Westberg | |
| 3,142,911 | A | 8/1964 | Waters | |
| 3,990,159 | A | 11/1976 | Borgeas | |
| 4,136,468 | A * | 1/1979 | Munschy | 36/97 |
| 4,145,822 | A * | 3/1979 | Mitchell et al. | 36/87 |
| 4,236,328 | A | 12/1980 | Friedlander | |
| 4,597,196 | A | 7/1986 | Brown | |
| 4,599,811 | A | 7/1986 | Rousseau | |
| 4,677,767 | A * | 7/1987 | Darby | 36/102 |
| D298,685 | S | 11/1988 | Dillard | |
| 4,808,469 | A * | 2/1989 | Hiles | 428/318.6 |
| 4,899,468 | A * | 2/1990 | Richbourg et al. | 36/110 |
| 4,955,147 | A | 9/1990 | Bos | |
| 5,014,041 | A * | 5/1991 | Rosen | 340/573.1 |
| 5,136,726 | A * | 8/1992 | Kellin et al. | 2/244 |
| 5,146,698 | A | 9/1992 | Tilles et al. | |
| 5,195,945 | A * | 3/1993 | Sandvig et al. | 602/8 |
| 5,203,793 | A * | 4/1993 | Lyden | 36/88 |
| 5,311,677 | A | 5/1994 | Mann et al. | |

(Continued)

FOREIGN PATENT DOCUMENTS

| | | |
|---|---|---|
| JP | 11-276205 | 10/1999 |

(Continued)

OTHER PUBLICATIONS

International Search Report and Written Opinion, mailed Aug. 14, 2008, from PCT Application No. PCT/US2008/055884.

(Continued)

*Primary Examiner*—Ted Kavanaugh
(74) *Attorney, Agent, or Firm*—Plumsea Law Group, LLC

(57) ABSTRACT

An article of footwear intended for use with a left foot and a right foot is disclosed. The article of footwear includes an interior space configured to fit a left for and a right foot. Additionally, the article of footwear may be associated with an insert that deforms during use.

26 Claims, 5 Drawing Sheets

U.S. PATENT DOCUMENTS

| | | | | |
|---|---|---|---|---|
| D351,053 | S | 10/1994 | Kessler | |
| 5,384,970 | A | 1/1995 | Melton | |
| 5,483,757 | A * | 1/1996 | Frykberg | 36/101 |
| D386,891 | S | 12/1997 | Rotches | |
| 5,727,336 | A | 3/1998 | Ogden | |
| 5,737,853 | A * | 4/1998 | Smejkal | 36/11.5 |
| D394,138 | S | 5/1998 | Haddad | |
| D403,842 | S | 1/1999 | Bair et al. | |
| 5,946,825 | A | 9/1999 | Koh et al. | |
| 6,195,917 | B1 * | 3/2001 | Dieckhaus | 36/44 |
| 6,247,250 | B1 * | 6/2001 | Hauser | 36/44 |
| 6,343,426 | B1 | 2/2002 | Robbins | |
| 6,481,120 | B1 | 11/2002 | Xia et al. | |
| 6,543,158 | B2 * | 4/2003 | Dieckhaus | 36/44 |
| 6,990,754 | B2 | 1/2006 | Bray, Jr. et al. | |
| 7,231,728 | B2 * | 6/2007 | Darby | 36/110 |
| 7,377,054 | B2 * | 5/2008 | Milner et al. | 36/15 |
| 2006/0265903 | A1 * | 11/2006 | Strong | 36/25 R |
| 2006/0265910 | A1 | 11/2006 | Lampley | |
| 2006/0277796 | A1 | 12/2006 | Gallegos | |
| 2007/0022630 | A1 | 2/2007 | Lundy Jr., et al. | |
| 2007/0234595 | A1 | 10/2007 | Davis | |

FOREIGN PATENT DOCUMENTS

| | | |
|---|---|---|
| JP | 2002-034602 | 2/2002 |
| JP | 2003-339401 | 12/2003 |

OTHER PUBLICATIONS

International Preliminary Report on Patentablity from PCT Application No. PCT/US2008/055884 mailed on Sep. 17, 2009.

* cited by examiner

ARTICLE OF FOOTWEAR FOR USE WITH A LEFT FOOT AND A RIGHT FOOT

BACKGROUND OF THE INVENTION

1. Field of the Invention

The present invention relates generally to footwear, and in particular an article of footwear intended for use with a left and right foot.

2. Description of Related Art

Typically, a child may use a pair of footwear without understanding the difference between left and right, resulting in the wrong shoe being placed on the left or right foot. Additionally, because a child's shoes may have less variability between the left and right shoe, a parent may also easily make the mistake of putting the shoes on the wrong feet. There is a need in the art for footwear without these problems.

Inserts that include materials capable of conforming to the contours of a foot after they have been initially manufactured have been proposed. Wolps (U.S. Pat. No. 4,167,824) discloses an insole insert that comprises an open cell foam base capable of conforming to and substantially retaining the shape of compressive forces applied to the insole, an elastic closed cell foam layer having a maximum compression set of less than 50% and a stretch fabric bonded to one face of the closed cell foam layer. The drawback of this design is that the open cell foam may only mold to the foot of the wearer after repeated use. There is a need for a substantial "break in" period for the Wolps design.

Johnson (US patent application publication 2005/0138844) discloses a multi-layered insole that supports the foot, provides impact resistance, and conforms to the shape of the foot. It comprises a pliable yet supporting heel-cup layer, a high impact foam later that sets very little, and an image foam later that sets to the wearer's foot shape thereby forming a cushion fit to the foot bed. A drawback of this invention is that a heel cup is necessary to provide structure to the insole and other layers so that the insole holds its shape. However the heel cup does not extend over the full length of the insert. There is a need in the art for a foam based insert that molds to the foot and does not require the use of an additional heel cup for structural support.

Generally, these types of insoles require the shape of the foot to be set after a substantial period of time. This is because adult feet generally require a certain amount of support that may be provided by a fixed mold of the foot shape within the insert. As a child's feet do not require this degree of support, an insert may be configured to mold to the foot during use, without any substantial set of the foam or material after the foot has been removed.

There is therefore a need in the art for inserts that may be used with an article of footwear that may be used with either the left foot or the right foot. These inserts will generally be large enough to accommodate the features of both a left foot and a right foot. Additionally, the inserts will substantially deform during use, but return to a non-deformed state following use.

There is also a need in the art for an article of footwear including an upper and an outsole that are configured to be used with both a left foot and a right foot.

SUMMARY OF THE INVENTION

An article of footwear intended for use with a left foot and a right foot is disclosed. In one aspect, the invention provides an article of footwear, comprising: an upper including an interior region that is configured to fit a left foot and a right foot; an insert that is configured to fit a left foot and a right foot; and where the insert is made of a deformable material that provides lateral and medial support to the foot during use.

In another aspect, the upper is symmetric along a longitudinal axis.

In another aspect, the upper is associated with an outer member.

In another aspect, the outer member includes an outsole.

In another aspect, the outer member includes a midsole.

In another aspect, the insert is made of foam.

In another aspect, the invention provides an article of footwear, comprising: an insert including a first layer and a second layer; the insert having a geometry that is symmetric about a longitudinal axis; and where the first layer is made of a deformable material that provides lateral and medial support to the foot during use.

In another aspect, the first layer is made of foam.

In another aspect, the first layer is made of a slow recovery foam.

In another aspect, the first layer is made of a heat reactive foam.

In another aspect, the first layer is made from rubber.

In another aspect, the first layer comprises a gel material.

In another aspect, the second layer is made of foam.

In another aspect, the second layer is made of ethyl-vinyl-acetate.

In another aspect, the insert is associated with an outer member.

In another aspect, the invention provides a left article of footwear and a right article of footwear, where: the left article of footwear is configured to be worn on a left foot; the right article of footwear is configured to be worn on a right foot; where the left article of footwear has a first geometry; where the right article of footwear has a second geometry; and where the first geometry is substantially similar to the second geometry.

In another aspect, the left article of footwear includes a left insert.

In another aspect, the left insert is made of a deformable material that provides lateral support to the foot during use.

In another aspect, the right article of footwear includes a right insert.

In another aspect, the right insert is made of a deformable material that provides lateral support to the foot during use.

In another aspect, the left insert is made of foam.

In another aspect, the right insert is made of foam.

In another aspect, the invention provides a method of making an article of footwear for either a left foot or a right foot comprising the steps of (i) providing an upper sized and dimensioned to fit either a left foot or a right foot; (ii) securing an outer member to the upper, the outer member sized and dimensioned to accommodate an upper for either a left foot or a right foot; and (iii) providing an insert positioned adjacent to the outer member, the insert being made from a deformable material that provides lateral support to, and reduces in shoe movement of, the foot during use.

In another aspect, the step of (iv) securing the insert to the outer member is included.

In another aspect, the insert is sized and dimensioned to fit either a left foot or a right foot.

In another aspect, the insert comprises at least two layers.

In another aspect, the invention provides a method of wearing an article of footwear having an upper, a deformable insert, and an outer member comprising the steps of (i) inserting a foot into the upper; (ii) pressing the foot into the insert so that the insert deforms from an initial configuration to conform to the shape of the foot; (iii) removing the foot from the upper to allow the insert to be restored to the initial configuration; (iv) inserting an opposite foot into the upper; and (v) pressing the opposite foot into the insert so that the insert deforms from the initial configuration to conform to the shape of the opposite foot.

Other systems, methods, features and advantages of the invention will be, or will become apparent to one with skill in the art upon examination of the following figures and detailed description. It is intended that all such additional systems, methods, features and advantages be included within this description, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like reference numerals designate corresponding parts throughout the different views.

DETAILED DESCRIPTION OF THE PREFERRED EMBODIMENTS

Figure 1:
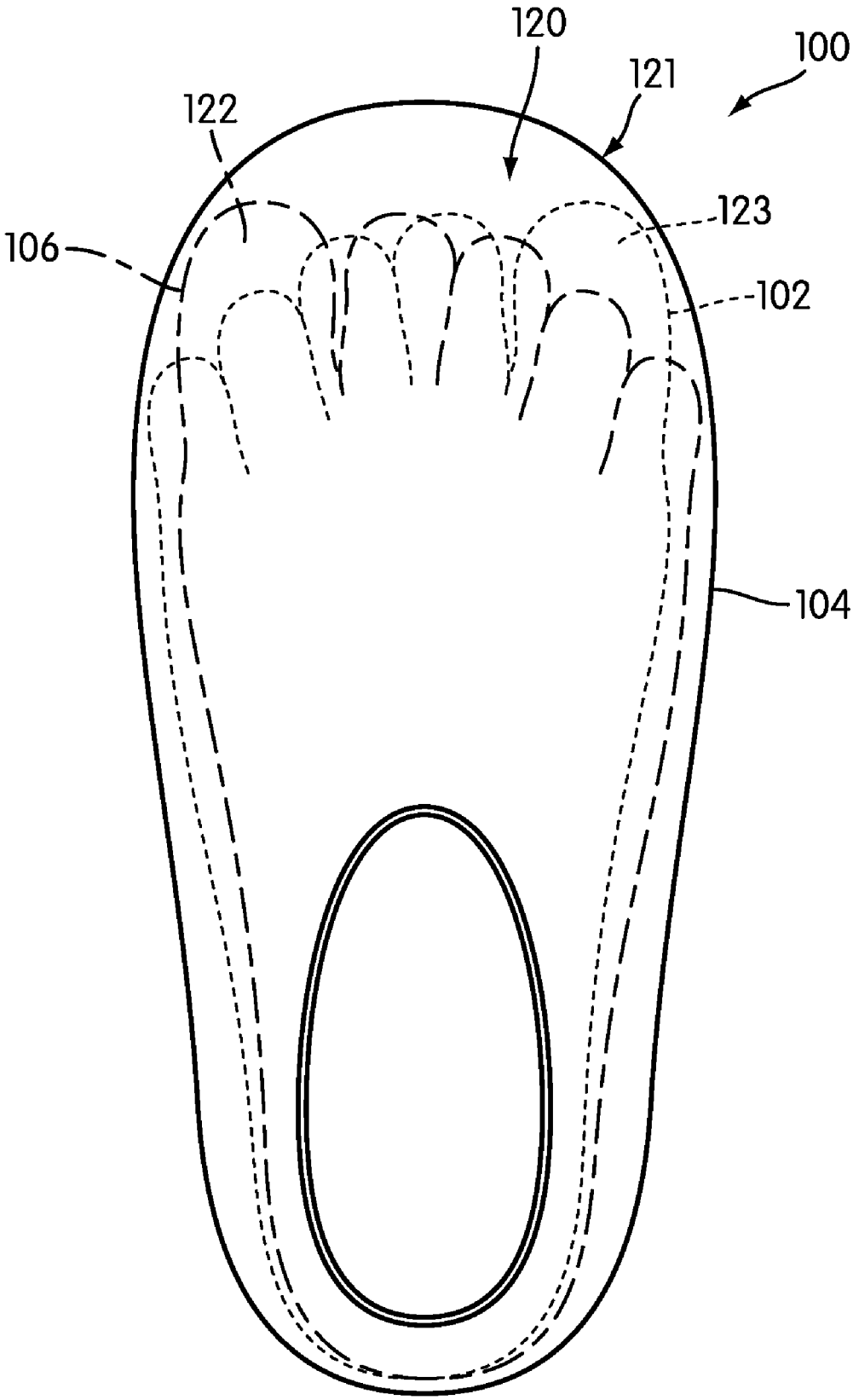
FIG. 1 is a top view of a preferred embodiment of an insert.

FIG. 1 is a top view of a preferred embodiment of article of footwear 100. In a preferred embodiment, article of footwear 100 may be a shoe intended to be used by a child. For clarity, the following detailed description discusses a preferred embodiment, however, it should be kept in mind that the present invention could also take the form of any other kind of footwear including, for example, athletic shoes, boots, sandals, as well as other kinds of footwear. In particular, although the preferred embodiment is configured for children, in other embodiments article of footwear 100 may be designed for adults.

The term child, as used throughout the following detailed description, may refer to infants, toddlers, as well as older children. Generally, a child, in the context of the present disclosure, may refer to a range of ages from infant to 6 years, or even older.

Preferably, article of footwear 100 may include provisions that allow it to be worn on either the left foot or the right foot. The feet are sometimes called "opposite", so that a foot and the opposite foot may mean the left foot and its opposite, the right foot, or the right foot and its opposite, the left foot. In the preferred embodiment, shown in FIG. 1, left foot 102 is schematically illustrated within upper 104 of article of footwear 100. Additionally, right foot 106 (also shown schematically) is superimposed over left foot 102. It is clear from the figure that article of footwear 100 has been manufactured with enough interior room so that the user may wear article of footwear 100 on either the left foot or the right foot. Preferably, interior region 120 is large enough to accommodate left foot 102 and right foot 106. In particular, toe box 121 is preferably long enough and wide enough on both sides of article of footwear 100 to accommodate left foot 102 and right foot 106, including first big toe 123 and second big toe 122, respectively.

Traditionally, the shape of an article of footwear is configured for either a left foot or a right foot. However, as seen in this embodiment, article of footwear 100 has a shape that does not predetermine an association with a particular foot. With this arrangement, article of footwear 100 may be selected and associated with either the left foot or the right foot. Preferably, a second article of footwear, substantially similar to article of footwear 100, may be manufactured to create a pair of footwear. This second article of footwear preferably also has a size and shape that allows the article of footwear to be associated with either the left foot or the right foot. Using this arrangement, the child or parent does not need to worry about distinguishing between left and right shoes, which may be difficult for both children and adults because of the small size of footwear for children. Furthermore, using this configuration, the pair of footwear may be rotated from one foot to another in order to minimize wear patterns associated with traditional footwear.

Figure 2:
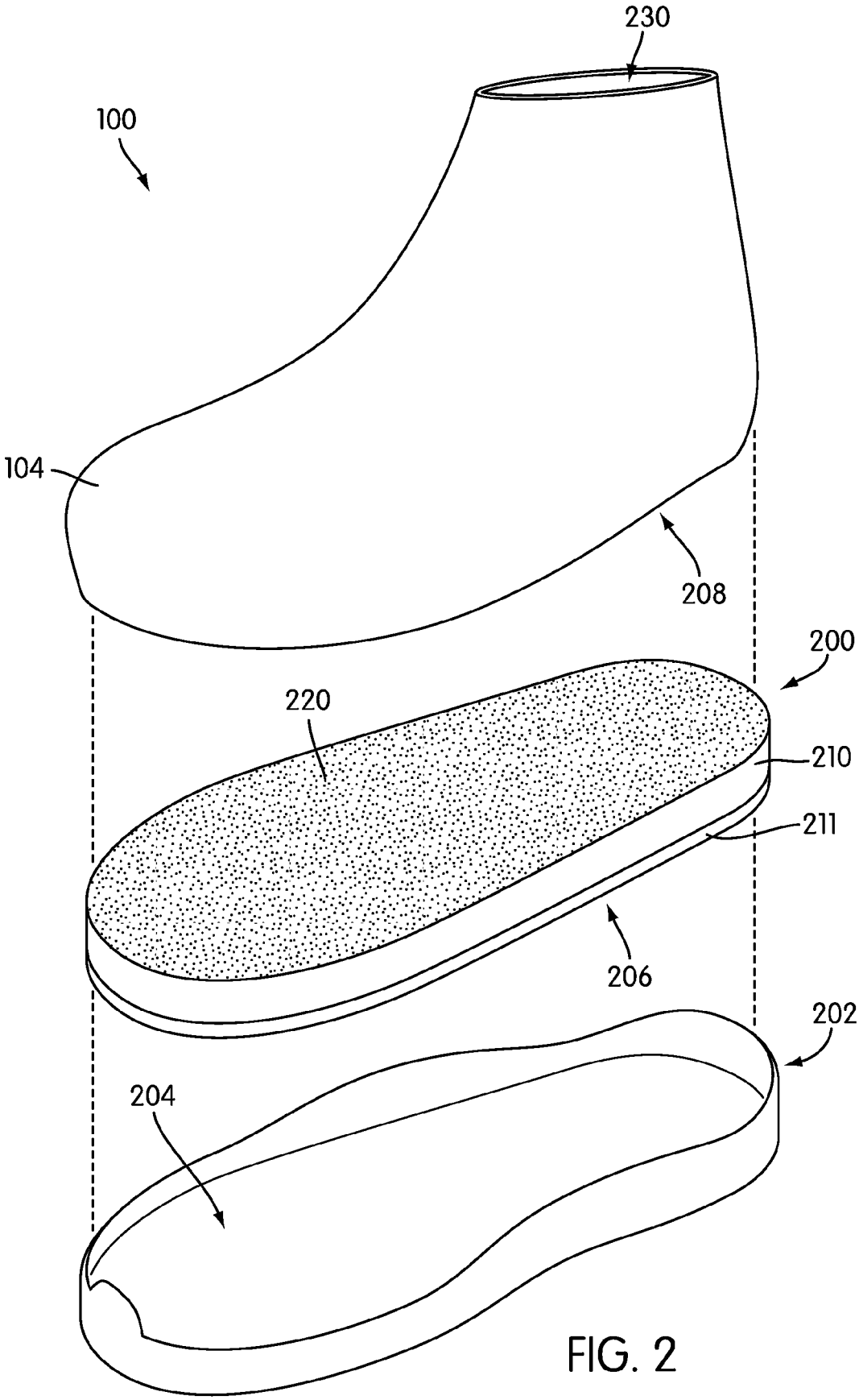
FIG. 2 is an exploded isometric view of a preferred embodiment of an article of footwear.

Referring to FIG. 2, article of footwear 100 may comprise insert 200 and outer member 202, in addition to upper 104. Generally, insert 200 may be disposed between outer member 202 and upper 104. In some embodiments, first side 204 of outer member 202 may be disposed against bottom side 206 of insert 200. Additionally, outer member 202 may be configured to attach to upper 104 along lower outer periphery 208.

In some embodiments, outer member 202 may include an outsole. Additionally, outer member 202 may include a midsole. In a preferred embodiment, outer member 202 may include a midsole and an outsole. Preferably, outer member 202 may be constructed of a foam material, or soft rubber.

As seen in FIG. 2, article of footwear 100 may be shaped like a 'bootie' or similar shoe associated with infants and toddlers. In some embodiments, article of footwear 100 may have another shape. In particular, upper 104 may take on a shape similar to an athletic shoe, boot, or other styles associated with various types of footwear. In a preferred embodiment, upper 104 may be decorated in a manner that does not predispose it towards being associated with a left foot or a right foot.

It should be understood that although the preferred embodiment includes an insert in addition to the upper and outer member, in some cases an article of footwear may comprise only an upper and an outer member. Although this alternative arrangement lacks the support features that an insert may provide, it may be used in cases where a child's shoes are worn primarily as a protective covering, especially in cases where the child does not walk.

Preferably, article of footwear 100 includes provisions for helping to support a user's foot. In some embodiments, article of footwear 100 may be configured to provide support for both a left foot and a right foot. In some embodiments, insert 200 may be deformable. In a preferred embodiment, insert 200 may be configured to conform to a user's foot, and in particular to both a left foot and a right foot.

In some embodiments, insert 200 may include multiple layers. In the embodiment shown in FIG. 2, insert 200 comprises first layer 210 and second layer 211. First layer 210 is preferably configured to receive a user's foot directly. Second layer 211 is preferably configured to contact outer member 202.

First layer 210 and second layer 211 may be made of any material, such as rubber or a gel encased within a plastic or rubber material. Preferably, first layer 210 and second layer 211 may be made of foam material. As first layer 210 may be disposed adjacent to a user's foot, it is preferably constructed of a foam that is substantially deformable. Examples of such foams that include slow recovery and/or heat reactive foams. In some cases, a visco-elastic foam, a latex foam, or a kind of memory foam may be used. Using this configuration, first layer 210 preferably molds to a user's foot.

In some embodiments, second layer 211 may also be made of a foam material. Examples of foam materials that may be used to form second layer 211 include non-reactive foams. In a preferred embodiment, second layer 211 may be constructed of ethyl-vinyl-acetate (EVA). Using this configuration, second layer 211 preferably provides additional comfort to the wearer and support to first layer 210. Additionally, second layer 211 may facilitate cushioning and the fit of insert 200 within upper 104.

In a preferred embodiment, insert 200 may also include lining 220. Lining 220 may be disposed on first layer 210. Using lining 220, insert 200 may be configured to interact with a user's foot in a desired way. Examples of different linings include, but are not limited to, soft linings, non-skid linings, reflexology linings, as well as other types of linings.

Preferably, insert 200 may be inserted into opening 230 formed in upper 104. In this case, insert 200 preferably sits within upper 104, above outer member 202, but is not fixedly attached. Instead, insert 200 may be removed and/or replaced. This arrangement allows a parent to purchase new inserts without having to purchase new shoes for their child.

Using a deformable insert with article of footwear 100 is useful because as the child's foot grows, the insert changes to accommodate slight changes in the size of the foot. This arrangement is preferable as a child's foot may often expand at a non-linear rate, making it difficult to find traditional shoes that fit the anatomy of the child's feet.

In other embodiments, insert 200 may be fixedly attached within article of footwear 100. In some embodiments, insert 200 may be fixedly attached to outer member 202. Insert 200 may be positioned on upper surface 204 and attached by an adhesive of some kind. In other embodiments, insert 200 may be positioned on upper surface 204 and fixedly attached, such as with an adhesive, to outer member 202 on an exterior edge of the midsole or outsole. In other embodiments, insert 200 may be attached to outer member 202 using known double lasting techniques. In still other embodiments, insert 200 may be fixedly attached to lower outer periphery 208, via stitching or an adhesive of some kind.

Figure 3:
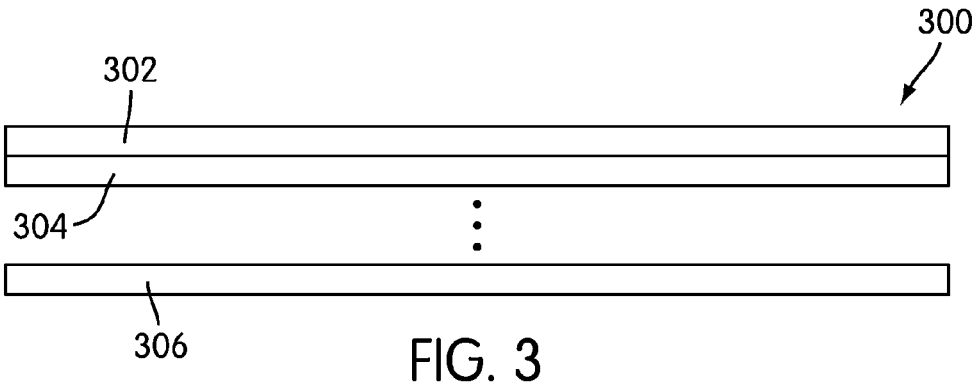
FIG. 3 is a side view of a preferred embodiment of an insert with multiple layers.

Generally, an insert may include any number of layers. Referring to FIG. 3, insert 300 preferably includes more than two layers. As with the previous embodiment, first layer 302 may be made of a foam that is deformable. In particular, first layer 302 may be made of a slow recovery and/or a heat reactive foam. Using this configuration, first layer 302 preferably molds to a user's foot.

Also, insert 300 preferably includes second layer 304, and nth layer 306. Second layer 304 is preferably constructed of a non-reactive foam, such as EVA. Preferably, nth layer 306 may also be constructed of a non-reactive foam such as EVA. Generally, any number of layers may be inserted between second layer 304 and nth layer 306. Each layer can be constructed from similar or different materials. With this arrangement, each additional layer may be added for comfort, support, or to help fit insert 300 within an article of footwear. Additionally, this layering system can be tuned to achieve the desired cushioning, support or feel.

In a preferred embodiment, an article of footwear, as well as the associated second article of footwear, may have a symmetric shape. Generally, the shape may be comprised of mirrored medial or lateral sides, depending on the desired need. In other embodiments, a mirrored medial or lateral side may be provided as an initial shape and then modified slightly to achieve a nearly symmetrical shape. Additionally, other symmetric shapes are possible.

Figure 4:
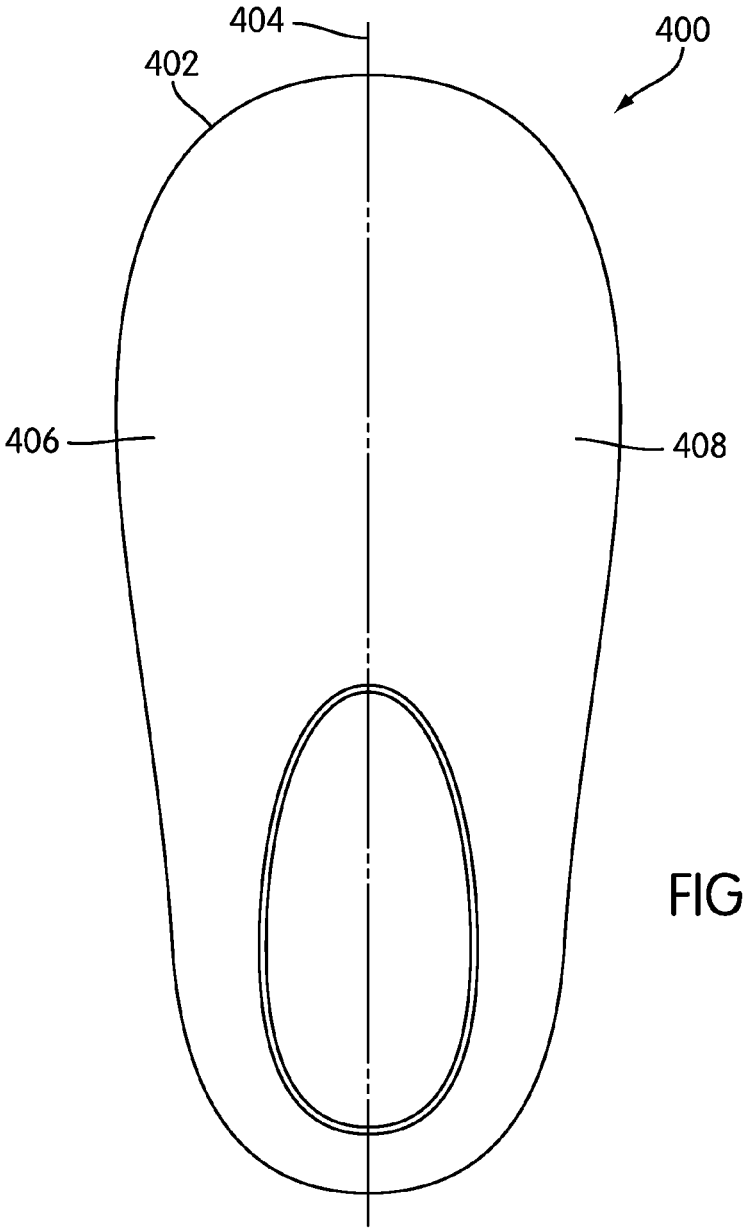
FIG. 4 is a top down view of a preferred embodiment of an article of footwear.

Referring to FIG. 4, article of footwear 400 preferably includes upper 402. In this embodiment, upper 402 is preferably symmetric about longitudinal axis 404. In other words, first half 406 of upper 402 is preferably a mirror image of second half 408 of upper 402.

Figure 5:
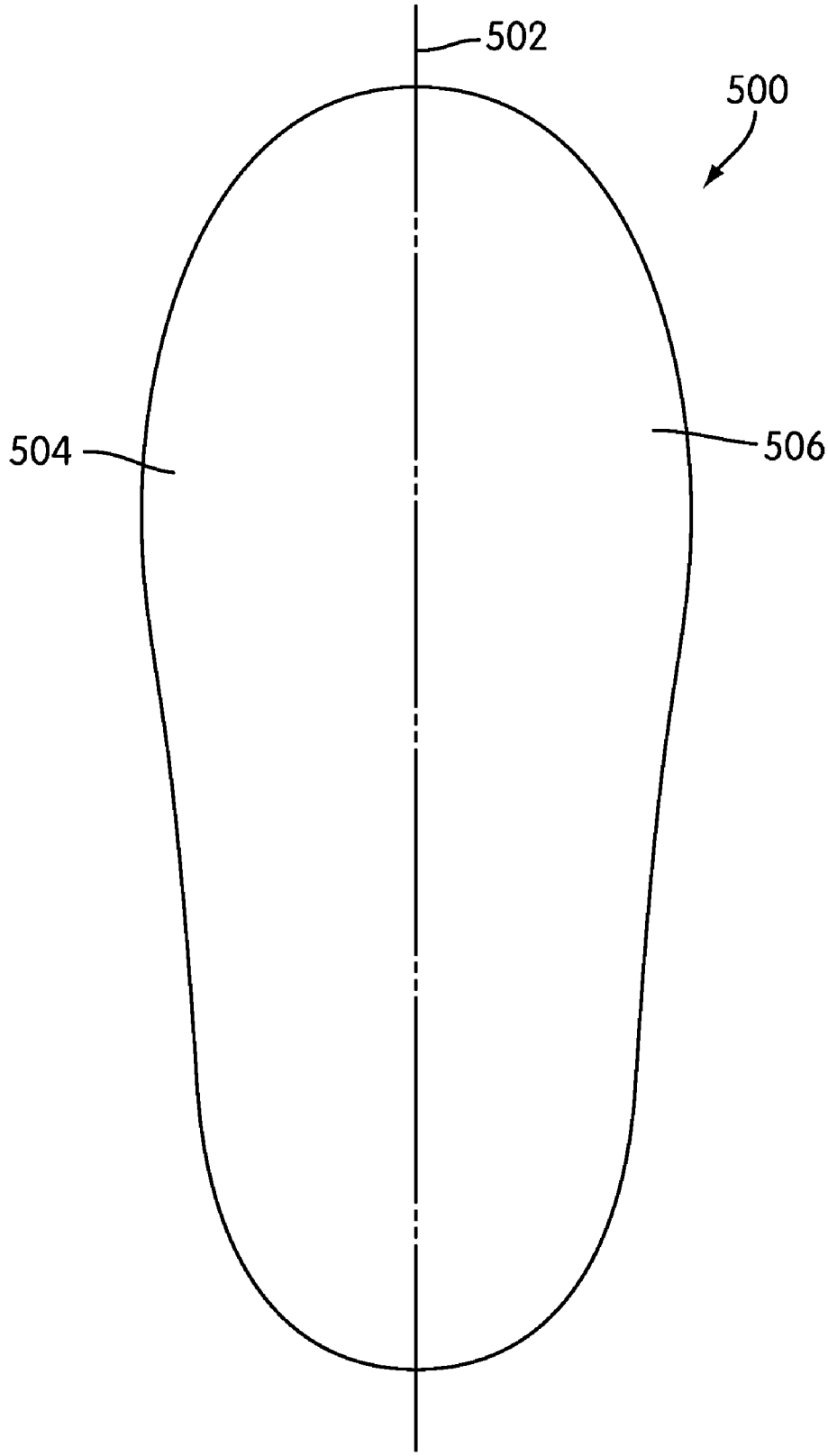
FIG. 5 is a top down view of a preferred embodiment of an insert.

Preferably, the insert and outer member associated with article of footwear 400 may also be symmetric along their length. FIG. 5 is a plan view of a preferred embodiment of insert 500. Preferably, insert 500 may be associated with article of footwear 400 and upper 402. In this preferred embodiment, insert 500 is preferably symmetric with respect to longitudinal axis 502. In other words, first half 504 of insert 500 is preferably a mirror image of second half 506 of insert 500. Additionally, the outer member associated with article of footwear 400 may be symmetric about a central axis as well.

Using this symmetric configuration, there is preferably no discernable distinction between the left side and the right side of the article of footwear, including the associated upper, insert, and outer member. This preferred embodiment allows a child to wear two such articles of footwear interchangeably. In some cases, this may reduce or eliminate the need for a child, or a parent, to spend time discerning between left and right articles of footwear. In many cases this may also reduce the tendency of a child to experience discomfort associated with having the wrong shoe on the wrong foot.

An additional beneficial feature is a potential increase in manufacturing efficiency as well as a reduction in manufacturing costs associated with using interchangeable footwear. Production efficiency may be increased because the articles of footwear do not need to be created in pairs, as any two articles of footwear forms a pair of footwear due to the lack of left and right distinctions. Also, manufacturing costs may be reduced because the number of molds and dies can be halved, as there is no need for separate 'left' or 'right' molds and dies. Manufacturing articles of footwear according to the invention may be performed using traditional methods. For example, an upper sized and dimensioned as described above to fit either a left foot or a right foot is provided, such as upper 104 described above. The upper is then placed on a last and conformed to the size and shape of the last. Thus, the last is also preferably sized and dimensioned to accommodate an upper sized and dimensioned to fit either a right foot or a left foot. Once the upper has been conformed to the last, an outer member, such as outer member 202 as described above, is attached to the upper using any method known in the art, such as with stitching or an adhesive. An insert, such as insert 200 described above, is also provided. The insert may be attached to the outer member prior to or concurrent with the outer member being attached to the upper, or the insert may be inserted into the upper and positioned on outer member after the outer member has been attached to the upper. Other, similar methods of manufacturing using known methodologies are also contemplated.

Some embodiments may include provisions for accommodating either a left or a right foot. In some cases, a deformable insert is used, as opposed to a highly contoured insert. As opposed to a contoured insert that only fits a particular foot (either left or right), a deformable insert may provide a customizable fit that may be adapted to either a left foot or a right foot, and therefore may be used with either foot.

Figure 6:
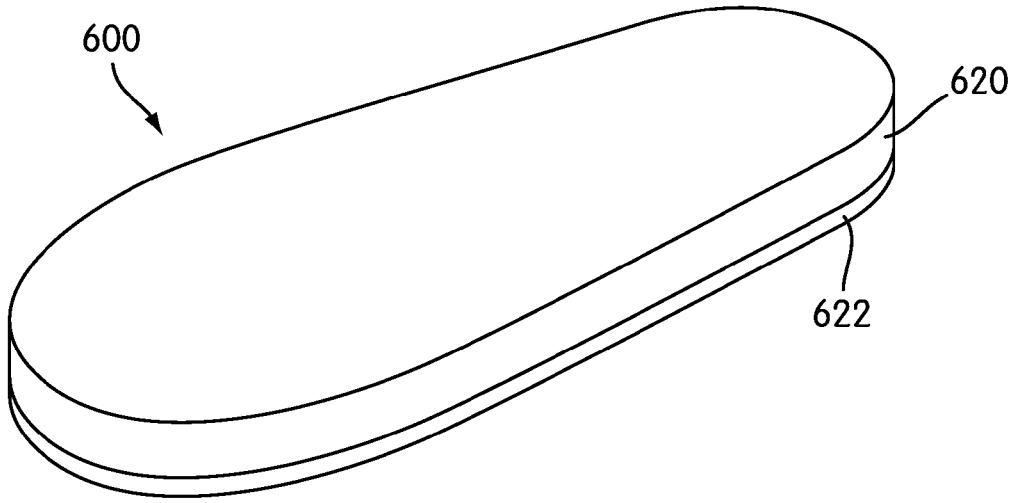
FIG. 6 is an isometric view of a preferred embodiment of an insert.
Figure 7:
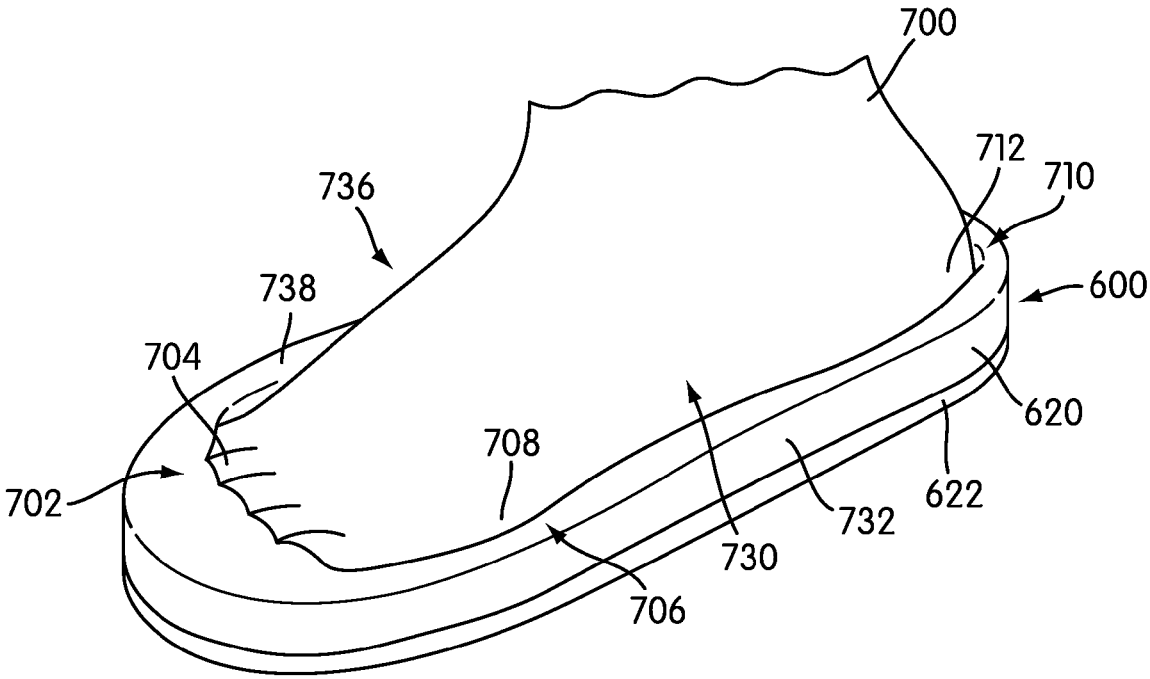
FIG. 7 is an isometric view of a preferred embodiment of foot contacting an insert.

Referring to FIGS. 6 and 7, insert 600 may be deformed following contact with foot right 700. FIG. 6 shows a preferred embodiment of insert 600 in an undeformed condition prior to contact with a user's foot. Following contact with a wearer's right foot 700 and the application of pressure associated with right foot 700 stepping on insert 600, insert 600 preferably deforms. In this embodiment, insert 600 includes several deformed regions. First deformed region 702 may be associated with toes 704 of foot right 700. Also, second deformed region 706 may be associated with ball of foot 708 of foot right 700. Finally, third deformed region 710 may be associated with heel 712 of foot right 700. In some embodiments, there may be other deformed regions. It should be understood that the deformed regions discussed in this embodiment are only examples of the ways that insert 600 may deform through contact with a user's foot.

Preferably, foot 700 may sink into insert 600. In addition to the deformed regions already discussed, medial side 730 of foot 700 may be partially covered by medial portion 732 of first layer 620 of insert 600. Medial portion 732 preferably provides support to medial side 730 of foot 700. Additionally, lateral side 736 of foot 700 may be partially covered by lateral side 738 of first layer 620. Lateral side 736 preferably provides support to lateral side 736 of foot 700. With this configuration, foot 700 may be prevented from slipping within an article of footwear and may further be protected from various injuries by reducing in-shoe movement of the foot.

In this embodiment, insert 600 comprises first layer 620 and second layer 622. In some embodiments, only first layer 620 may deform. Preferably, first layer 620 may be made of a slow recovery and/or heat reactive foam. Second layer 622 may be made of a non-slow recovery foam, such as EVA.

Preferably, deformed regions 702, 706 and 710 are only temporarily deformed. As foot 700 is removed from insert 600, the foam or other material associated with each of the deformed regions 702, 706 and 710 is preferably restored to an initial configuration. Generally, this initial configuration may be substantially similar to the embodiment of insert 600 seen in FIG. 6. In other words, following the removal of foot right 700, insert 600 preferably returns to an initial, non-deformed, state.

Using this configuration, insert 600 preferably provides comfort and support to right foot 700. Additionally, because the deformation of insert 600 is only temporary, a left foot may later be associated with insert 600. Following contact with the left foot, insert 600 may preferably be deformed in a manner that conforms to and supports the left foot.

While various embodiments of the invention have been described, the description is intended to be exemplary, rather than limiting and it will be apparent to those of ordinary skill in the art that many more embodiments and implementations are possible that are within the scope of the invention. Accordingly, the invention is not to be restricted except in light of the attached claims and their equivalents. Also, various modifications and changes may be made within the scope of the attached claims.

We claim:

1. An article of footwear, comprising:

an upper including an interior region that is configured to fit a left foot and a right foot, wherein the article of footwear extends from a heel end to a toe end along a longitudinal axis, wherein the longitudinal axis separates a first half of the upper from a second half of the upper, and wherein the first half of the upper is a mirror image of the second half of the upper;

an insert that is configured to fit a left foot and a right foot, wherein the longitudinal axis separates a first half of the insert from a second half of the insert, and wherein the first half of the insert is a mirror image of the second half of the insert;

an outer member attached to the upper and configured to fit a left foot and a right foot, wherein the longitudinal axis separates a first half of the outer member from a second half of the outer member, and wherein the first half of the outer member is a mirror image of the second half of the outer member;

wherein the longitudinal axis separates a first half of the article of footwear from a second half of the article of footwear;

wherein there is no discernible distinction between the first half of the article of footwear and the second half of the article of footwear;

wherein the insert is made of a deformable material that temporarily deforms from an initial non-deformed state to provide lateral and medial support to one of the left foot and the right foot during use, returns to the initial non-deformed state after the use, and temporarily deforms again from the initial non-deformed state to provide lateral and medial support to the other of the left foot and the right foot during a subsequent use;

wherein, during use, the insert is configured to deform sufficiently enough such that a user's foot sinks into the insert to such an extent that a deformed portion of the insert at least partially covers a side surface of the foot and a non-deformed upper surface of the insert is above an upper surface of the user's foot; and wherein the insert is configured to deform sufficiently enough to at least partially cover an upper surface of the user's foot such that the insert embraces the user's foot to reduce movement of the user's foot within the article of footwear.

2. The article of footwear according to claim 1, wherein the insert comprises a gel encased within one of a plastic material and a rubber material.

3. The article of footwear according to claim 1, wherein the insert deforms sufficiently enough to at least partially cover a medial side surface and a lateral side surface of a user's foot to reduce movement of the foot within the article of footwear.

4. The article of footwear according to claim 3, wherein the outer member includes a midsole.

5. The article of footwear according to claim 1, wherein the outer member includes an outsole.

6. The article of footwear according to claim 1, wherein the insert deforms sufficiently enough to cup a user's foot having a bottom sole surface and a plurality of side surfaces substantially perpendicular to the bottom sole surface, wherein a first deformed region of the insert at least partially covers a side toe surface of the plurality of side surfaces, wherein a second deformed region of the insert at least partially covers a side ball surface of the plurality of side surfaces, and wherein a third deformed region of the insert at least partially covers a side heel surface of the plurality of side surfaces.

7. The article of footwear according to claim 1, wherein the insert embraces a toe of the user's foot.

8. The article of footwear according to claim 1, wherein the insert has a first side that is configured to contact the user's foot and a second side that is opposite to the first side and is configured to face the outer member, and wherein the insert further comprises a lining disposed only on the first side of the insert.

9. The article of footwear according to claim 1, wherein the upper surface comprises a toe nail.

10. The article of footwear according to claim 1, wherein the insert is made of foam.

11. An article of footwear, comprising:

an insert including a first layer configured to receive a user's foot directly and a second layer configured to contact an outer member of the article of footwear;

the article of footwear extending from a heel end to a toe end along a longitudinal axis;

the longitudinal axis separating a first half of the insert from a second half of the insert;

the first half of the insert being a mirror image of the second half of the insert;

wherein there is no discernible distinction between the first half of the insert and the second half of the insert;

wherein the first layer is made of a deformable material that temporarily deforms from an initial non-deformed state to provide lateral and medial support to one of a left foot and a right foot during use, returns to the initial non-deformed state after the use, and temporarily deforms again from the initial non-deformed state to provide lateral and medial support to the other of the left foot and the right foot during a subsequent use;

wherein, during use, the first layer is configured to deform sufficiently enough such that the user's foot sinks into the first layer to such an extent that a deformed portion of the first layer at least partially covers a side surface of the user's foot and a non-deformed upper surface of the first layer is above an upper surface of the user's foot; and wherein the deformed portion of the first layer at least partially covers an upper surface of the foot such that the first layer embraces the user's foot to provide the lateral and medial support and reduce movement of the user's foot within the article of footwear.

12. The article of footwear according to claim 11, wherein the insert has a first side that is configured to contact the user's foot and a second side that is opposite to the first side and is configured to face the outer member, and wherein the insert further comprises a lining disposed only on the first side of the insert.

13. The article of footwear according to claim 11, wherein the first layer is made of foam.

14. The article of footwear according to claim 13, wherein the first layer is made of a slow recovery foam.

15. The article of footwear according to claim 13, wherein the first layer is made of a heat reactive foam that temporarily deforms when pressed by a foot and returns to the initial non-deformed state when the foot is removed.

16. The article of footwear according to claim 13, wherein the first layer is made from rubber.

17. The article of footwear according to claim 13, wherein the first layer comprises a gel material.

18. The article of footwear according to claim 11, wherein the second layer is made of foam.

19. The article of footwear according to claim 18, wherein the second layer is made of ethyl-vinyl-acetate.

20. The article of footwear according to claim 11, wherein the insert is associated with an outer member.

21. A method of making an article of footwear for either a left foot or a right foot comprising:

providing an upper sized and dimensioned to fit either a left foot or a right foot, wherein the article of footwear extends from a heel end to a toe end along a longitudinal axis, wherein the longitudinal axis separates a first half of the upper from a second half of the upper, and wherein the first half of the upper is a mirror image of the second half of the upper;

securing an outer member to the upper, the outer member sized and dimensioned to accommodate an upper for either a left foot or a right foot, wherein the longitudinal axis separates a first half of the outer member from a second half of the outer member, and wherein the first half of the outer member is a mirror image of the second half of the outer member; and providing an insert positioned adjacent to the outer member, wherein the longitudinal axis separates a first half of the insert from a second half of the insert, wherein the first half of the insert is a mirror image of the second half of the insert, wherein the insert is made from a deformable material that temporarily deforms from an initial non-deformed state to provide lateral support to, and reduces in shoe movement of, one of the left foot and the right foot during use and returns to the initial non-deformed state after the use, wherein, during use, the insert is configured to deform sufficiently enough such that a user's foot sinks into the insert to such an extent that a deformed portion of the insert at least partially covers a side surface of the user's foot and a non-deformed upper surface of the insert is above an upper surface of the user's foot, wherein the insert is configured to deform sufficiently enough to at least partially cover an upper surface of the user's foot such that the insert embraces the user's foot to reduce movement of the user's foot within the article of footwear, wherein the longitudinal axis separates a first half of the article of footwear from a second half of the article of footwear, and wherein there is no discernible distinction between the first half of the article of footwear and the second half of the article of footwear.

22. The method of claim 21, further comprising securing the insert to the outer member.

23. The method of claim 21, wherein the insert comprises a gel encased within one of a plastic material and a rubber material.

24. The method of claim 21, the insert comprising at least two layers.

25. The method of claim 21, wherein the insert has a first side that is configured to contact the user's foot and a second side that is opposite to the first side and is configured to face the outer member, and wherein the method further comprises affixing a lining only on the first side of the insert.

26. The method of claim 21, wherein the upper surface of the user's foot comprises a toe nail.

* * * * *